US008631619B2

(12) United States Patent
Clayton et al.

(10) Patent No.: US 8,631,619 B2
(45) Date of Patent: Jan. 21, 2014

(54) WINDOW AND DOOR GRILLE ATTACHMENT SYSTEM

(75) Inventors: Dan Clayton, Houlton, WI (US); Tim Mullen, Bloomer, WI (US); Marvin Kammin, Minneapolis, MN (US)

(73) Assignee: Andersen Corporation, Bayport, MN (US)

( * ) Notice: Subject to any disclaimer, the term of this patent is extended or adjusted under 35 U.S.C. 154(b) by 36 days.

(21) Appl. No.: 13/069,781

(22) Filed: Mar. 23, 2011

(65) Prior Publication Data

US 2011/0265415 A1 Nov. 3, 2011

Related U.S. Application Data

(60) Provisional application No. 61/316,562, filed on Mar. 23, 2010.

(51) Int. Cl.
*E06B 3/70* (2006.01)

(52) U.S. Cl.
USPC ..... 52/456; 52/204.61

(58) Field of Classification Search
USPC ..... 52/455, 456, 204.6, 204.61, 204.53, 52/783.13, 656.8, 656.9, 204.7; 411/347, 411/348, 907, 908
See application file for complete search history.

(56) References Cited

U.S. PATENT DOCUMENTS

| | | | | | |
|---|---|---|---|---|---|
| 3,108,336 | A | * | 10/1963 | Tate | 52/204.61 |
| 3,221,462 | A | * | 12/1965 | Pomeroy | 403/230 |
| 3,381,431 | A | * | 5/1968 | Jacobson | 52/309.1 |
| 3,918,202 | A | * | 11/1975 | Smith | 52/106 |
| 4,437,284 | A | * | 3/1984 | Cribben et al. | 52/456 |
| 4,586,306 | A | * | 5/1986 | Webb | 52/204.61 |
| 4,838,001 | A | * | 6/1989 | Battles | 52/456 |
| 4,890,435 | A | * | 1/1990 | Wilkening et al. | 52/456 |
| 5,437,133 | A | * | 8/1995 | Pliml | 52/456 |
| 5,487,245 | A | * | 1/1996 | Dazo et al. | 52/204.61 |
| 6,155,010 | A | * | 12/2000 | Becken et al. | 52/204.61 |
| 6,230,456 | B1 | * | 5/2001 | Merchlewitz | 52/204.61 |
| 6,718,704 | B2 | * | 4/2004 | Plummer et al. | 52/204.61 |

* cited by examiner

*Primary Examiner* — William Gilbert
*Assistant Examiner* — Beth Stephan
(74) *Attorney, Agent, or Firm* — Womble Carlyle Sandridge & Rice, LLP

(57) ABSTRACT

A grille attachment system is provided for releasably attaching a grille made of crisscrossing grille components to a window or door having a frame and a glazing unit. The attachment system includes grille clips on the ends of the grille components that are each movable between a first or inactive position and a second or active position in which they engage the frame of the window or door to hold the grille in place. Movement of the grille toward engagement with the glazing unit of the window or door causes the clips to move to their second positions, thereby engaging the frame and holding the grille in place. Pulling the grille away from the glazing unit causes the clips to move back to their first positions, thereby releasing the grille from the frame and the window or door.

27 Claims, 4 Drawing Sheets

WINDOW AND DOOR GRILLE ATTACHMENT SYSTEM

REFERENCE TO RELATED APPLICATION

Priority is hereby claimed to the filing date of U.S. provisional application 61/316,562 filed on 23 Mar. 2010.

TECHNICAL FIELD

This disclosure relates generally to windows and doors and more specifically to windows and doors having attached grilles that simulate the look of traditional divided lights.

BACKGROUND

In the historical past, many windows and doors were manufactured with true divided lights. More specifically, their sashes had muntins that defined rectangular openings. A separate glass pane was disposed in each of the rectangular openings and secured with glazing or trim. In recent years, demand for more energy efficiency has lead to windows and doors having a single glass or glazing unit, which usually is an insulated double pane unit secured within a surrounding window or door frame. While this is more energy efficient and simplifies manufacturing, some consider the appearance of a single large glass pane to be plain or otherwise objectionable. Accordingly, grilles have been developed that can be installed in a window sash or door panel overlying the glazing unit. These grilles are profiled to mimic the look and architectural appearance of historical divided light windows, especially from a distance. Grilles can be installed on the inside, the outside, or both sides of a window sash or door panel to reproduce in greater or less detail the appearance of a true divided light window or door.

The option to attach grilles to windows and doors to create the appearance of true divided lights is a highly desirable feature of a window or door product line. Finding suitable attachment techniques has proven problematic, however, for several reasons. For example, the grille, when attached, should appear to be an integral part of the window or door, with no visible attachment components. Further, the grille must be easily removable from the window or door to allow effective cleaning of the underlying glazing unit. Finally, the attachment mechanism should not mar or scratch the finishes of wood or clad surfaces when the grille is repeatedly attached to and removed from the window or door.

Previous solutions to these and other grille attachment challenges have proven only partially satisfactory. Some such solutions employ a plunger system wherein extendable plungers in the ends of the crisscrossing grille components can be extended to engage grommets inserted into the visible part of a sash or door panel surrounding a glazing unit. Unfortunately, these grommets necessitate additional fabrication, and, once installed, accommodate only a single grille configuration. Also, if a user decides not to apply the grilles or to remove them, the window sash or door panel is left with visible grommets which have no apparent function, a situation considered undesirable by many. Additionally, if during production and after installation of the grommets, a sash is found to have a defect, especially a defect at or near an end, it must be discarded rather than salvaged by cutting off the ends of the lineals and using them for a smaller window. This is because cutting off an end of a lineal or the entire sash will no doubt place the grommets in the wrong locations for receiving a grille. U.S. Pat. Nos. 5,437,133 and 6,230,456 disclose grille attachment systems using grommets of the type just described.

Another prior solution, disclosed in U.S. Pat. No. 5,622,017, as well as in other patents owned by the assignee of the present disclosure, involves forming a groove in the visible surfaces of a sash or door panel surrounding a glazing unit. Plungers on the ends of the grille components fit into the groove for holding the grille in place. This solution suffers from at least the problem that the visible groove may not provide the appearance that some customers prefer and may be considered unsightly even when a grille is attached because the groove is still visible. Yet another solution, disclosed in U.S. Pat. No. 6,718,704, also owned by the assignee of the present disclosure, includes metal clips that are forced between the sash lineals and the glazing unit when the grille is installed. While largely effective, the clips may nevertheless have a tendency in some cases, to mar the sash, especially when the sash is made of a softer wood, and generally are visible which can be considered unsightly.

A need therefore exists for an attachment system for securing decorative grilles to window sashes and door panels that addresses these and other shortcomings of prior art attachment solutions. It is to the provision of such an attachment system and to windows and doors incorporating such a system that the present invention is primarily directed.

SUMMARY

U.S. provisional patent application 61/316,562, to which priority is claimed above, is hereby incorporated by reference in its entirety.

The invention will be discussed below primarily within the context of grilles for window sashes. It will be understood, however, that the disclosure applies equally to door panels, including hinged door panels and sliding door panels. Thus, the terms window and window sash below should be read to include doors and door panels as well.

Briefly described, a window includes a sash with a detachable grille that simulates the appearance of true divided lights. The grille is formed of crisscrossing components that define rectangular openings. The components have opposite ends that rest against the inside edges of a sash frame when the grille is attached to a window sash. The ends of each component carries a grille clip configured to engage the sash frame when the grille is pressed into the frame in such a way that the grille clips of the grille components hold the grille in place within the window sash. In one embodiment, the grille clips comprise spring biased plungers disposed in the ends of the grille components that engage a specially chamfered sash frame to snap into a chamfer between the sash frame and its glazing unit. The plungers retract to allow the grille to be removed when the grille is pulled away from the glazing unit and sash.

In another embodiment, articulating clip fingers project at an angle away from and beneath the ends of the grille components when in their inactive configurations. In this embodiment, the clip fingers engage the glass surface of the glazing unit as a grille is pressed into a sash overlying a glazing unit. As the grille continues to be pressed into place, the fingers pivot toward the ends of the grille components and their ends extend outwardly to engage the inside edges of the sash frame and thereby hold the grille in place. The clip fingers snap into their outwardly pivoted active configurations for holding the grille to the sash, but snap back to their inactive configurations to allow the grille to be removed when the grille is pulled with sufficient force away from the glazing unit. In either embodiment, the grille is applied simply by being pressed into its sash and removed by being pulled away from the sash and the clips automatically snap from their inactive to their active configurations or vice versa as necessary. The clips are configured so that no scratching or marring of a sash frame occurs and no part of the clip is visible when the grille is attached to the sash.

Thus, a window or door grille attachment system is now provided that addresses successfully the challenges and shortcomings mentioned above and more. The attachment system and its function will be better understood upon review of the detailed description set forth below, made in conjunction with the accompanying drawing figures, which are briefly described as follows.

DETAILED DESCRIPTION

Figure 1:
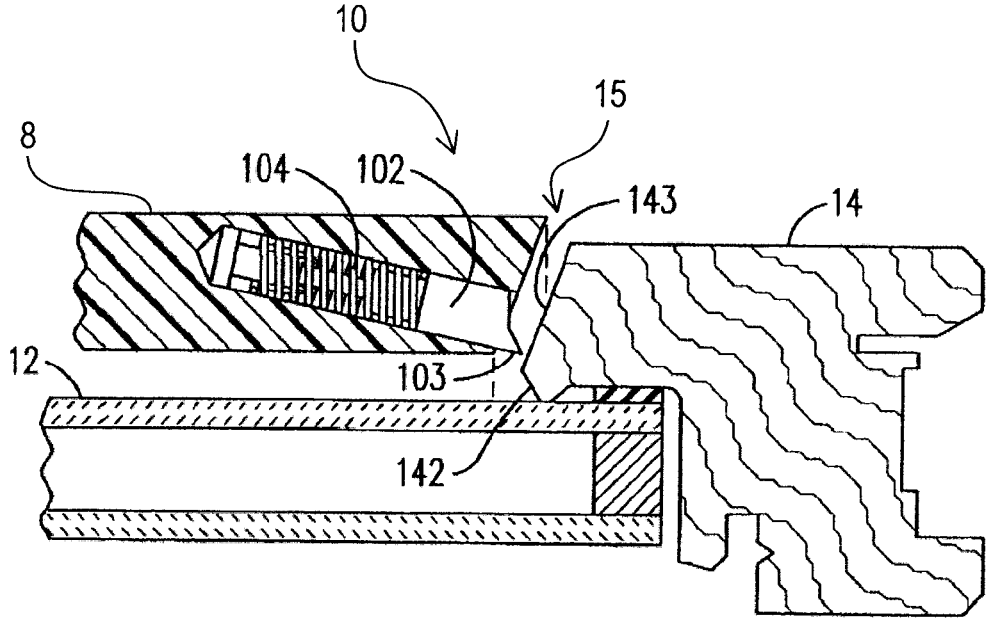
FIG. 1 is a cross sectional view of a portion of a window sash and grille illustrating principles of the disclosure in one embodiment and showing the grille being moved into the sash for attachment.

Reference will now be made in more detail to the drawing figures described above. In FIG. 1, a part of a grille comprising an end portion 10 of one of the crisscrossing grille components 8 is shown in position for installation of the grille in a window having sash frame 14 and glazing unit 12. While the end portion 10 of one grille component 8 is illustrated, it will be understood that most or all of the ends of the grille components forming the grille will be configured in the same way. An angled bore or pocket is formed in the end 10 of the grille component 8 and a plunger 102 having leading edge 103 is slidably disposed in the bore projecting from the open end thereof. Plunger 102 is urged outwardly from end 10 of the grille component by spring 104. An internal structure within the bore limits the outward movement of plunger 102 to the extended position shown in FIG. 1 necessary for locking grille 10 in place as detailed below. Thus, the plunger 102 is captured within the bore, is spring biased to its extended position, and is yieldably movable into the bore against the bias of the spring 104.

Figure 2:
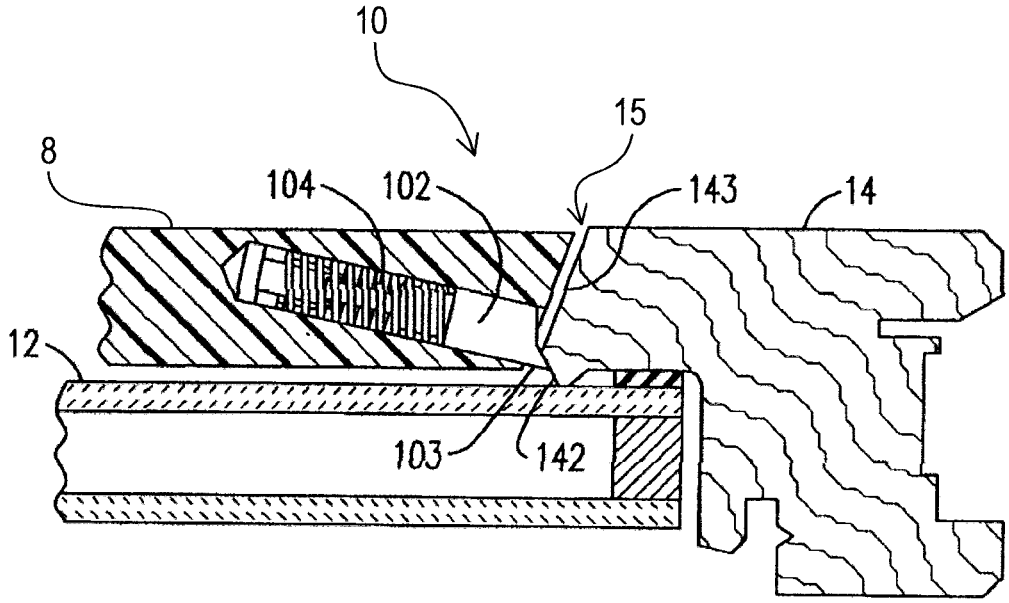
FIG. 2 is a cross sectional view of the window sash of FIG. 1 with the grille in position within the sash.

Referring to FIGS. 1 and 2, the grille is installed by pressing it toward the top pane of glazing unit 12 as illustrated by the phantom lines in FIG. 1. As the grille is pressed toward the glazing unit, the leading edge 103 of each plunger 102 engages and slides along an edge surface 143 formed into an inside edge portion 15 of sash frame 14. This, in turn, pushes the plungers back into the end portions 10 of the grille components 8, compressing springs 104 and allowing grille to move into position against glazing unit 12. As the grille approaches engagement with the glazing unit, the leading edges 103 of the plungers 102 move beyond the innermost edges of edge surface 143. At this point, springs 104 urges the plungers 102 outward so that their leading edges 103 snap beneath a chamfer 142 also formed into the inside edge portion 15 of the sash frame 14, the chamfered surface 142 extending along the surface of the glazing unit. It will thus be seen that the grille is installed in the sash frame 14 quickly and easily simply be being pressed into the sash frame and toward the glazing unit until the plungers 102 in the end portions 10 of the grille components 8 snap into place beneath chamfers 142. The grille can be removed merely be reversing the process; i.e. by pulling the grille away from the glazing unit. This causes the chamfered surfaces 142 to push the plungers 102 back into their bores against the bias of springs 104 until the leading edges 103 of the plungers snap out of the chamfer thus allowing the grille to be removed.

Plungers 102 preferably are made of a low friction plastic material, to facilitate installation and removal of the grille and reduce the likelihood of the plungers scratching or marring the sash. The plungers also may be made of metal or a coated metal if desired for some situations. It will be appreciated that while leading edge 103 is portrayed in FIGS. 1 and 2 as being rather sharp, it may be and preferably is more rounded. Further, the plungers may be rectangular in cross section or otherwise formed with a wider leading edge. This presents greater contact area between the leading edges of the plungers and the inside edge portion 15 of sash frame 14 to aid the leading edges in sliding past the edge surfaces 143 without causing damage or excessive frictional drag or sticking. The angles of leading edge 103, chamfer 142, and edge surface 143 can be chosen to allow smooth operation without frictional hang-ups or sticking of plunger 102 during installation and removal of the grille. In addition, the force of spring 104 preferably is selected to allow smooth installation and removal of the grille, while holding the grille in place securely after installation.

Optionally, the risk of marring the sash with the ends of the plungers may be further reduced by providing the plungers with a locking and triggering mechanism, such as, for example, a catch in the bores and a latch on the plungers. Prior to installation using such a mechanism, the plungers 102 can be pressed into the end portions 10 of the grille components 8, whereupon the latch snaps into the catch to hold the plungers in a retracted position. The holding device can be equipped with a trigger that releases the latch from the catch and thus releases the plunger upon contact between the trigger and the glazing unit, thereby allowing the plunger to extend or pop out under the bias of the spring when the grille is pressed against the glass. Thus, in such an embodiment the grille is locked in place without the ends of the plungers sliding down and potentially marring the edge surfaces 143 of the sash frame 14.

As described above, the grille attachment system includes a chamfer 142 or other like recessed feature on the sash frame to receive the ends of the plungers rather than installing grommets or merely pressing a clip into the material of the sash frame. It has been found that the chamfer 142 can be made sufficiently small to have no noticeable effect on the appearance of the window, while still being effective to capture and hold the leading edges 103 of the plungers. Moreover, the chamfer does not appear to cause excessive moisture absorption in wooden sashes, as might occur when condensation forms during cold or humid weather. An additional advantage of the chamfer discovered by the inventors is that it simplifies painting or other finishing of the sash frame because the innermost edge of surfaces 143 are spaced slightly from the glazing unit and the line between the sash frame and the glass is hidden from view beneath the chamfers under ordinary viewing conditions. Further, the sash finish, which may be paint, polyurethane, or other finishing product, can coat a small marginal strip at the edge of the glass within the chamfer. This improves the sash to glass seal without causing a visible uneven edge that can detract from the appearance of the window.

Figure 3:
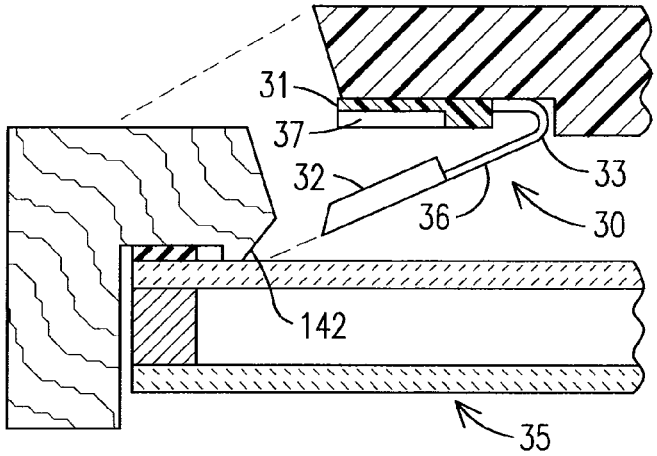
FIG. 3 is a cross sectional view of a portion of a window sash and grille illustrating principles of the disclosure in another embodiment with the grille being moved into the sash for attachment.

With a peripheral chamfer as described above incorporated a standard feature of a grille attachment system, other and alternative grille clip configurations are possible. Referring to FIG. 3 for example, a hinged grille clip 30 is attached beneath the end portions of the crisscrossing components of a grille so that the clips are not visible from the front side of the grille. Each grille clip of this embodiment is made up of a body 31 and an arm 36 joined by a living hinge 33. A detent 32 is formed on the end of the arm 36 and includes an end configured to extend into the chamfer 142 of a sash frame. The body 31 is formed with a recess 37 sized to receive a portion of the detent 32 and configured to hold the detent 32 securely but releasably in place within the recess 37. In other words, the detent 32 and recess 37 are configured so that the detent 32 can snap into and snap out of the recess 37. Prior to installation, as shown in FIG. 3, the grille clips are open with their arms and detents 32 hinged outward from the ends of the grille components toward the glazing unit 35. Living hinges 33 of each clip maintains detent 32 in this position until the grille is progressively moved into place against the glazing unit.

Figure 4:
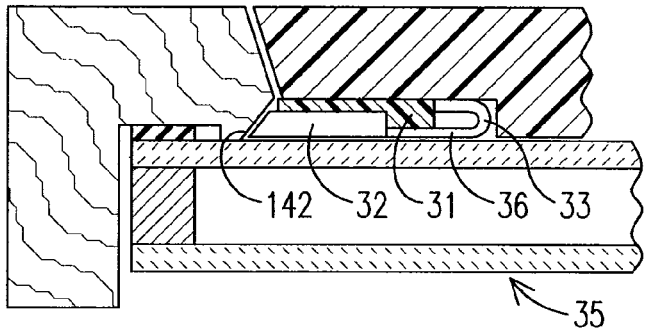
FIG. 4 illustrates the window sash of FIG. 3 with the grille installed and in position within the sash.

As the grille is moved toward engagement with the glazing unit, the detents 32 contact the glass first and this begins to hinge the arms 36 toward the bodies 31 of the clips. Further movement of the grille toward engagement with the glass moves the detents 32 against the slight bias of the living hinges 33 into the recesses 37 of the clip bodies 31, where the detents snap into their respective recesses. Each grille clip 30 is thus secured in a closed or active configuration with the end of its detent extending into the chamfer 142, as illustrated in FIG. 4. Each detent 32 can be releasably held in place within its recess 37 by any appropriate means such as, for instance, a friction fit, a snap fit, an adhesive strip, hook and loop fasters, an interference fit, or other effective mechanisms. When it is desired to remove the grille from the sash, the grille is simply pulled away from the glazing unit with sufficient force to unsnap the detents of the grille clips from their recesses, thus allowing the grille to be moved out of the sash. It will thus be seen that the grille can be snapped into and out of the sash with ease as needed.

Figure 5:
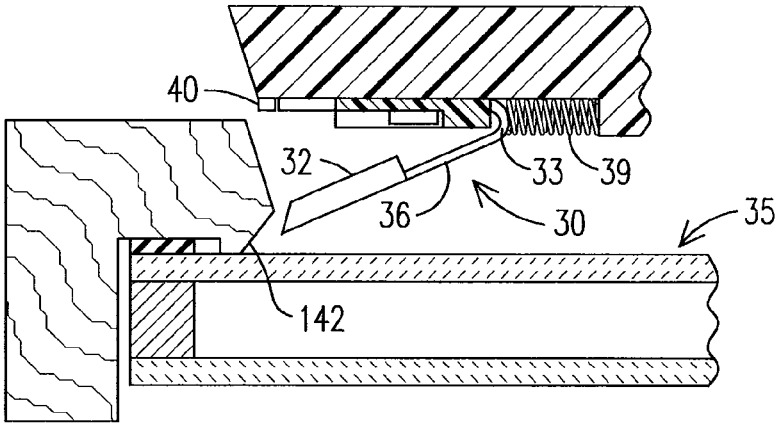
FIG. 5 is a cross sectional view of a portion of a window sash and grille illustrating principles of the disclosure in yet another embodiment.

FIG. 5 illustrates a modified embodiment of the just described grille attachment system. The grille clip itself operates in the same way as the previous embodiment. However, in this embodiment, the body of the grille clip 30 is longitudinally slidably mounted in the end portions of the grille components and is yieldably urged toward the ends of the components by a spring 39. A stop 40 limits the outward extension of sliding grille clip. The slidable grille clip of this embodiment helps to compensate for tolerances in grille dimensions to ensure that the end of detent 32 fits securely within the chamfer 142 even when variations in grille dimensions, frame dimensions, or grille component lengths occur. As an alternative to the spring, living hinge 33 may be made sufficiently flexible to allow detent 32 to move in a manner that compensates for grille dimensional variations during installation to ensure that the end of detent 32 to fits snugly within the chamfer.

Figure 6:
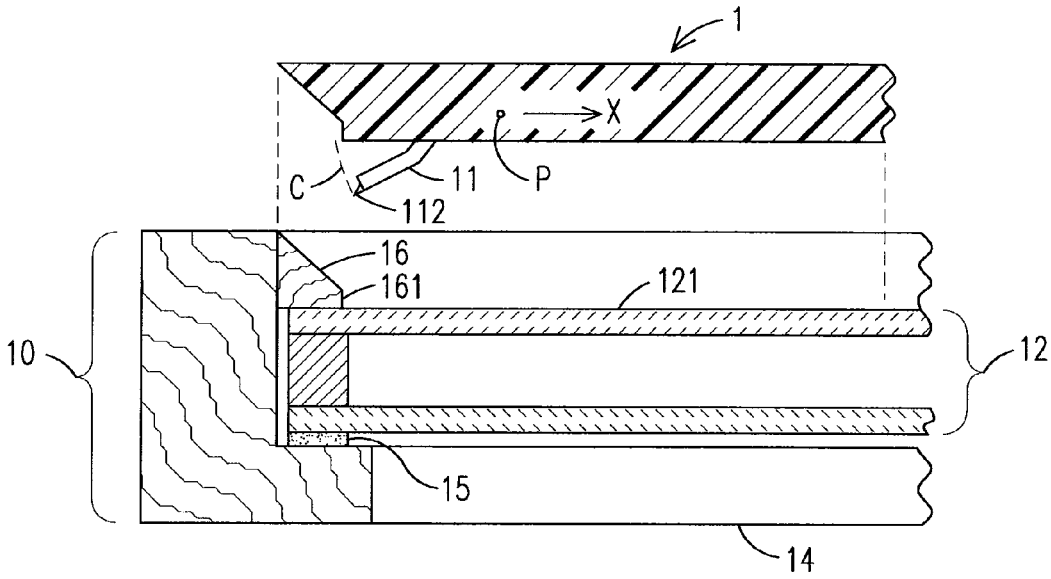
FIGS. 6 through 13 illustrate a system for attaching and removing a grille to a window sash that embodies principles of the disclosure in still another embodiment.

FIG. 6 illustrates an alternate grille attachment system that does not require that a chamfer be formed in the sash frame along the glass surface. In this embodiment, a window sash (or door panel) 10 is made up of a frame, which may be a sash frame 14 that supports a glazing unit 12. Glazing unit 12 is sealed in the sash frame 14 by adhesive sealant 15. A glazing strip or glass stop 16 is installed around the peripheral portion of the glazing unit on the opposite side of the window sash 10 to improve the appearance of the sash 14 and provide additional sealing between glazing unit 12 and sash 14. Window sash 10 is typically installed in a building structure with glass stop 16 located on the side of the panel facing the interior of the structure. Window sash 10 may be part of a window unit that is attached directly to a wall or other surface of a building structure, or may be part of a door or other like fenestration unit that is attached to a building structure.

Grille component 1, shown in partial view in FIG. 6, is one component of a grille made up of a number of crisscrossing grille components. A grille clip assembly according to aspects of the invention is installed in the end portions of each of the grille components and each grille clip includes a normally downwardly projecting clip arm 11 having and engagement tip 112. In this embodiment, the engagement tip is shaped as a barb. The clip assembly itself is described in more detail below. The grille in this embodiment is attached to window sash 10 by moving the grille into window sash 10, as indicated by phantom lines in FIG. 6, until clip arm 11 contacts surface 121 of glazing unit 12. The grille 1 is then further pressed into the window sash until is rests against the glazing unit. In the process, clip arm 11 is forced upwardly toward the end of the grill component 1. More specifically, the clip arm 11 rotates upwardly through arc C as it pivots substantially about a pivot axis P. Pivot axis P is defined by a pivoting and sliding mechanism mounted within the grille component 1, as described in detail below. Further, pivot axis P is movable against the force of a biasing spring in direction X and is urged toward glass stop 16 by the spring (or other resilient member). As a result, when grille is pressed against glazing unit 12, tip portion 112 of clip arm 11 engages surface 161 of glass stop 16 as the clip arm 11 begins to pivot toward the grille component 1. The tip member 112 thus may slightly pierce or otherwise couple with the glass stop to form an interference or frictional fit between the ends of the grille components and the glass stop.

Figure 7:
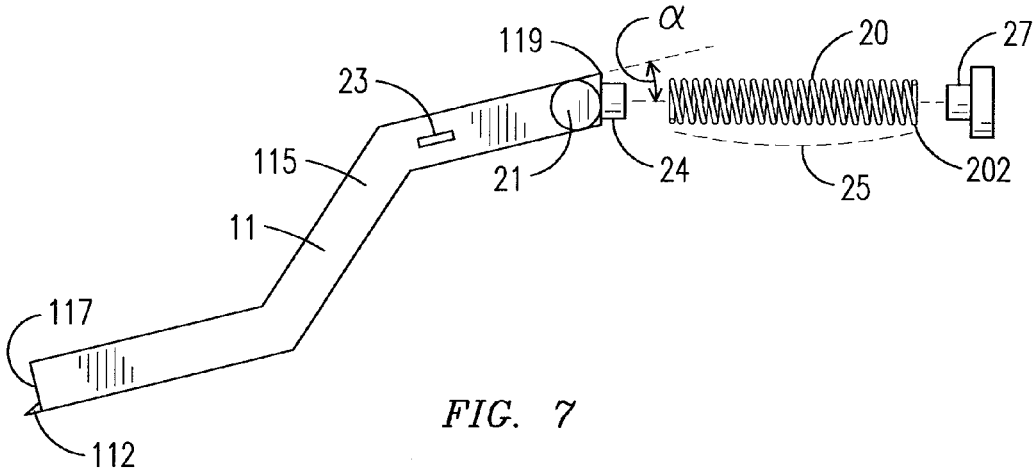
Figure 8:
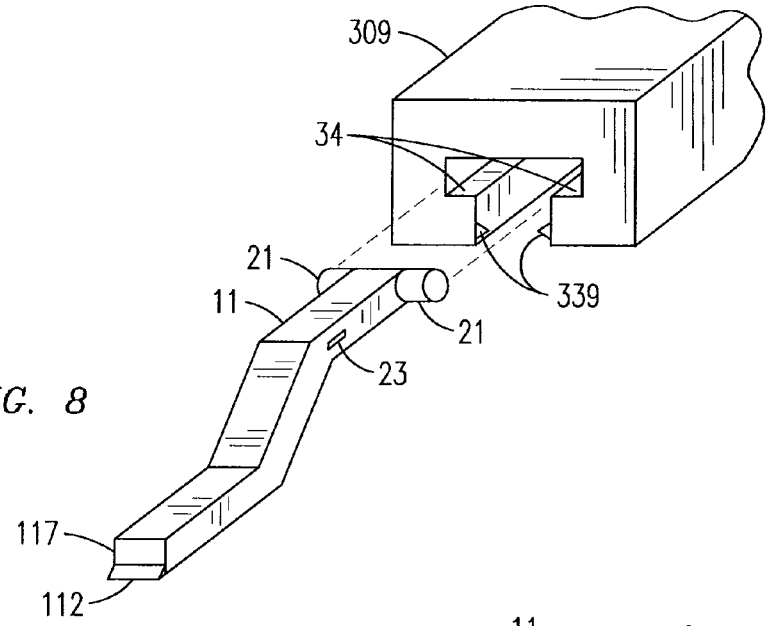

FIGS. 7 and 8 illustrate the clip mechanism of this embodiment in more detail. Clip arm 11 is seen to be one end portion of a lever 115 and is formed with glass stop engagement tip 112 on a free end 117. A detent 23 is formed on the sides of the lever 115 intermediate its ends. Lever 115 further comprises a spring receiver 24 located at second end 119 and a pair of pivot shafts 21 projecting outwardly from opposite sides of the lever proximate the second end 119. Spring receiver 24 is configured to receive coil spring 20 and preferably is dimensioned to produce a snug or press fit with spring 20. A button 27 is configured to plug the opposite end of the spring 20. In this way, once spring 20 has been attached to spring receiver 24, the spring, lever member, button, and clip arm can be handled as a unit. The upper portion of the lever 115 is oriented at angle alpha ($\alpha$) relative to spring 20. With this configuration, when spring 20 is in its natural straight orientation, lever 115 and its clip arm 11 extend in a direction generally away from a grille component, as shown in FIG. 7, and the spring biases the clip arm to this inactive position. As the clip arm is pivoted up into the end of the glazing component, the spring bends into an arc 25 and thus continues to bias the clip arm toward its inactive position. The clip arm thus can snap back to its inactive position under the influence of the coil spring 20.

FIG. 8 illustrates in simplified form a preferred installation of the lever 115 in a grill block 309, which in turn fits in the end of a grille component 30. More specifically, a T-slot preferably is formed in the grille block 309 and defines slots 34 sized to receive slidably the pivot shafts 21 of the lever 115 with the lever and clip arm projecting through the open portion of the T-slot. The spring 20 and more specifically its button 27 (FIG. 7) engages the back of the T-slot to urge the lever and its clip arm outwardly and away from the end of a grille component 30 in which the assembly is installed. When a grille with crisscrossed grille components, each or some of which carries a lever and clip arm assembly as described, is moved into a window sash and toward engagement with the glass unit, clip arm 11 engages the glass and is rotated upward toward the end of the grille component. In the process, the spring 20 is bent into arc 25 as illustrated in FIG. 7. Engagement tab 112 eventually contacts surface 161 of glass stop 16 causing the second end 119 of the pivot 115 to move inwardly against the bias of spring 22. The bias of the spring thus urges the tip 112 into tight engagement with the surface 16 to form an interference fit between the tip 112 and the surface 16. The spring also compensates for variations in the lengths of the grill components or the dimensions of the sash frame. As an alternative to the grille block 309, the ends of the grille components may simply be milled to form a T-slot, in which case the lever and spring assembly may be installed directly into the ends of grille components.

The grille block 309 (or the end of a grille component) further is formed with inwardly projecting latches 339, which are sized and configured to engage with the detents 23 of the pivot 115 when a grille is fully pressed into a window sash. An interference fit is established between the detents and the latches thereby preventing unwanted reverse rotation of arm 11 and holding grille in place within the sash. When it is desired to remove the grille from the sash, it is simply pulled away from the sash with sufficient force to dislodge the detents 23 from the latches 339, which releases the ends of the grille components from the sash frame.

In cases wherein grille components are molded or extruded plastic or composite parts, grille blocks 309 may be molded directly into the end portions of the grille components. Further, the shape of lever 115 need not be limited to the configuration portrayed in FIGS. 7 and 8, but may be any shape that provides suitable operation and positioning and holding of the grille. Likewise, while spring base block 27 is shown as a separate component, it may be integrally formed with grille block 30, or may, in other embodiments, simply be part of the grille component itself. The pivot shafts 21 may be retained within channels 34 by any suitable means. For example, stops may be inserted into channels 34 after the pivot member 115 has been installed by sliding its pivot shafts 31 into the channels 34. Alternatively, the stops may be part of grille block 309, and grille clip assembly can be installed from the opposite of grille block 309, after which spring base block 27 may be installed and fixedly attached to grille block 309. In yet another embodiment, spring 20 may be fixedly attached to both spring receiver 24 and spring base block 27, wherein base block 27 is then fixedly attached to grille block 309.

While detents 23 and latches 33 are illustrated as being projections that snap past one another to form an interference fit, other embodiments of holding features are also contemplated. For example, the detents and latches may be configured in alternate shapes such that, in addition to holding arm 11 releasably in its holding position, the detents and latches also urge engagement tip 112 toward surface 161 when grille member is pressed against the surface 121 of glazing unit 12. It is also contemplated that configurations that utilize a frictional fit between pivot member 114 and/or arm 11 and grille block 30 may also be useful. In yet another embodiment, pivot 115 and clip arm 11 may be held releasably in their holding orientations by one or more magnets or by a combination of a magnet, which may be attached to either clip arm 11 or grille block 309, and a ferromagnetic material, which may be attached to the grille block or the clip arm depending on the location of the magnet.

Engagement of the end of the clip arm 11 with glass stop surface 16 may be accomplished in a variety of alternate ways different from the barb illustrated in FIG. 7. Examples include (1) providing a blade-like feature that inserts itself between glass stop 16 and glass surface 121; (2) providing teeth, knurls, serrations or other like features on the end of the clip arm 11 that indent or bite into surface 161; (3) providing features, such as protrusions, on the end of the clip arm 11 that mate with corresponding indentations or other features provided in surface 161; or (4) providing elastomeric or other like materials on the ends of the clip arms to provide frictional engagement with the surface 116.

Figure 9:
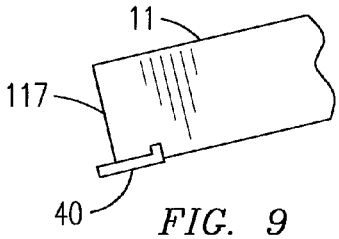
Figure 10:
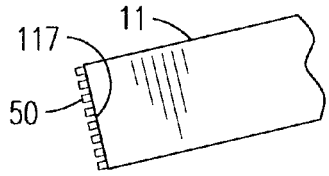

FIGS. 6-8 are illustrative of a triangular barb configuration 112 intended to fit into a small gap between glass stop 16 and surface 121 of the glazing unit. The effectiveness of this configuration may be enhanced by providing a gap or chamfer on glass stop 16 where it meets the glazing unit to receive blade 22. In an alternative embodiment, illustrated in FIG. 9, end 117 of the clip arm is provided with a thinner sharp blade-like projection that preferably is sufficiently sharp to produce its own gap between stop 16 and surface 121 or otherwise penetrate the glass stop slightly to attach grille components thereto. FIG. 10 illustrates a knurled, toothed, or serrated surface 50 on the end of clip arm 11 that engages surface 161 of glass stop 16 and may produce small indentations in surface 16 upon engagement for holding. Holding may be enhanced by providing a complementary knurled, toothed, or serrated configuration on surface 161.

Figure 11:
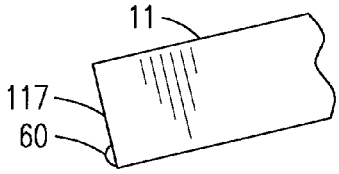
Figure 12:
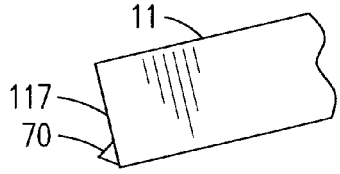
Figure 13:
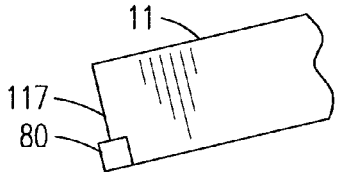

FIG. 11 illustrates a rounded protrusion 60 that may into a corresponding recess in surface 161 of glass stop 16. An alternative embodiment using this principle is portrayed in FIG. 12, wherein a sharper protrusion that fits into a corresponding sharper recess in surface 161 may be used. FIG. 13 illustrates the use on the end 117 of the clip arm of an elastomeric bead 80 that projects from the end of the clip arm. The elastomeric bead is formulated to compress against surface 161 of glass stop 16 to form a frictional or adhesive-like holding mechanism. Performance of this configuration may be enhanced by providing knurls or grooves in surface 161.

The invention has been described herein in terms of preferred embodiments and methodologies considered by the inventors to represent the best modes of carrying out the invention. A wide range of additions, deletions, and modifications, some of which are described above, might well be made to the illustrated embodiments by those of skill in the art without departing from the spirit and scope of the invention, which is determined only by the claims.

What is claimed is:

1. A grille attachment system for releasably attaching a grille to a window or door having an opening with a glazing unit mounted therein, the grille attachment system comprising:

a frame surrounding the opening and supporting the glazing unit therein, the frame including an inside edge portion defining a recess extending around and facing the surface of the glazing unit, and an edge surface extending outwardly from the recess;

the grille formed of a plurality of grille components sized to span the opening and having end portions spaced from each other and configured to contact the edge surface to support the grille within the opening; and a plurality of clips located at the end portions of the grille components, the clips being movable without human intervention between first positions and second positions in response to movement of the grille toward engagement with the glazing unit, at least a portion of the clips engaging the recess to secure the grille to the frame when the clips are in their second positions.

2. A grille attachment system as claimed in claim 1 and wherein the clips are configured to engage the glazing unit to move the clips from their first to their second positions as the grille is moved toward engagement with the glazing unit.

3. A grille attachment system as claimed in claim 1 and further comprising features on the clips to releasably retain the clips in their second positions.

4. A grille attachment system as claimed in claim 3 and wherein the features comprise a spring configured to bias the clips to their second positions when the clips are moved to their second positions.

5. A grille attachment system as claimed in claim 4 and wherein the spring further biases the clips toward the ends of the grille components.

6. A grille attachment system as claimed in claim 3 and wherein the features comprise detents that engage when the clips are moved to their second positions.

7. A grille attachment system as claimed in claim 3 and wherein the features are configured to establish a friction fit when the clips are moved to their second positions.

8. A grille attachment system as claimed in claim 3 and wherein the features are configured to establish an interference fit when the clips are moved to their second positions.

9. A grille attachment system as claimed in claim 1 and wherein the clips comprise a plunger disposed in the end portions of the grille components, the plunger being yieldable biased toward its second position.

10. A grille attachment system as claimed in claim 9 and wherein the plunger is configured to engage the edge surface as the grille is moved toward engagement with the glazing unit to move the plunger to its first position, and to engage the recess as the plunger moves back to its second position.

11. A grille attachment system as claimed in claim 1 and wherein each of the clips comprises a first portion secured to the grille component and a second portion, the second portion being pivotable with respect to the first portion between a first orientation defining the first position of the clip and a second orientation defining the second position of the clip.

12. A grille attachment system as claimed in claim 11 and wherein the second portion is hingedly attached to the first portion and pivots about the hinge.

13. A grille attachment system as claimed in claim 11 and wherein the first portion includes pivot pins disposed within slots and wherein the second portion pivots about a pivot axis defined by the pivot pins.

14. A grille attachment system as claimed in claim 13 and further comprising a spring operatively coupled to the second portion of the clip, the spring being oriented with respect to the second portion to bias the first portion toward its first orientation when the clip is in its first position.

15. A grille attachment system as claimed in claim 14 and wherein the spring further biases the clip toward the end of the grille component.

16. A grille attachment system as claimed in claim 1 and wherein the clips further move between their second positions and their first positions in response to the grille being pulled away from the glazing unit to facilitate removal of the grille from the window or door.

17. A window comprising the grille attachment system of claim 1.

18. A door comprising the grille attachment system of claim 1.

19. A grille attachment system as claimed in claim 1 and wherein the recess of the inside edge portion of the frame is a chamfered surface.

20. A method of releasably attaching a grille formed of grille components to a window or door having a frame surrounding a glass panel, the frame including an inside edge portion having a recess extending around and facing the surface of the glass panel and an edge surface extending outwardly from the recess, and wherein at least some of the grille components have clips mounted at their end portions, the method comprising the steps of:

(a) moving the grille progressively toward the glass panel;

(b) as the grille moves toward the glass panel, engaging a portion of each clip with the window or door to move the clips without human intervention from inactive positions toward active positions;

(c) engaging the recess of the inside edge portion with a portion of each clip as the clips move toward their active positions to secure the clips and the grille to the window or door; and (d) releasably securing the clips in their active positions.

21. The method of claim 20 and wherein step (b) comprises engaging a portion of each clip with the edge surface of the inside edge portion of the frame of the window or door.

22. The method of claim 20 and wherein step (b) comprises engaging a portion of each clip with the glass panel of the window or door.

23. The method of claim 20 and further comprising engaging the recess of the inside edge portion with a barb on the clip.

24. The method of claim 20 and further comprising engaging the recess of the inside edge portion with a blade on the clip.

25. The method of claim 20 and further comprising engaging the recess of the inside edge portion with a knurled, toothed, or serrated surface on the clip.

26. The method of claim 20 and further comprising engaging the recess of the inside edge portion with a resilient bead on the clip.

27. The method of claim 20 and wherein the recess of the inside edge portion of the frame is a chamfered surface.

* * * * *